US005193967A

United States Patent [19]

Sartorio

[11] Patent Number: 5,193,967

[45] Date of Patent: Mar. 16, 1993

[54] DEVICE FOR TRANSFERRING A WORKPIECE

[75] Inventor: Franco Sartorio, Turin, Italy

[73] Assignee: Amada Company, Limited, Japan

[21] Appl. No.: 721,543

[22] PCT Filed: Nov. 28, 1990

[86] PCT No.: PCT/JP90/01538

§ 371 Date: Apr. 24, 1991

§ 102(e) Date: Apr. 24, 1991

[87] PCT Pub. No.: WO91/08067

PCT Pub. Date: Jun. 13, 1991

[30] Foreign Application Priority Data

Nov. 30, 1989 [IT] Italy ..... 68065 A/89

[51] Int. Cl.[5] ..... B65H 29/00

[52] U.S. Cl. ..... 414/225; 198/339.1; 198/468.4; 198/463.3; 414/797

[58] Field of Search ..... 414/222, 224, 225, 226, 414/796.9, 797, 749, 752; 198/339.1, 463.3, 468.4, 468.2, 468.5

[56] References Cited

U.S. PATENT DOCUMENTS

| | | | |
|---|---|---|---|
| 3,892,324 | 7/1975 | Faletti, Jr. | 414/749 |
| 3,910,426 | 10/1975 | Wagner . | |
| 4,365,920 | 12/1982 | Morgan | 414/226 X |
| 5,080,552 | 1/1992 | Takahashi et al. | 414/224 X |

FOREIGN PATENT DOCUMENTS

| | | |
|---|---|---|
| 0135095 | 3/1985 | European Pat. Off. . |
| 0213667 | 3/1987 | European Pat. Off. . |
| 1279625 | 10/1968 | Fed. Rep. of Germany . |
| 3508462 | 9/1986 | Fed. Rep. of Germany . |
| 2223104 | 10/1974 | France . |
| 2534510 | 4/1984 | France . |
| 55-001937 | 9/1980 | Japan . |
| 2211002 | 6/1989 | United Kingdom . |

*Primary Examiner*—Michael S. Huppert
*Assistant Examiner*—Donald W. Underwood
*Attorney, Agent, or Firm*—Wigman & Cohen

[57] ABSTRACT

A device for transferring a workpiece to be presented for working includes a carrying member for picking up the workpiece from a withdrawal station. The carrying member includes an chute for receiving and transferring a product to a collecting station upon completion of the working.

11 Claims, 8 Drawing Sheets

DEVICE FOR TRANSFERRING A WORKPIECE

BACKGROUND OF THE INVENTION

The present invention relates to a device for transferring a workpiece to be presented for working such as bending and, more particularly, to a device which transfers the workpiece from a withdrawal station to a scheduled place for the working, and after completion of the working, from the scheduled place to a collecting station.

Some transfer devices comprises a movable arm and suction cups provided on the movable arm. The arm picks up a sheet from the pile of metal sheet at the withdrawal station and carries it to a manipulator of a working machine such as a bending machine. After completion of the working, the arm receive the worked sheet and carries it to the collecting station.

In such a transfer device as described above, when transferring the workpiece, the time required for the transferring is determined by the speed of movement of the arm. Accordingly, it is limited by preformance of the arm, and if one wishes to shorten the transferring time, larger power and construction are required.

SUMMARY OF THE INVENTION

An object of the present invention is to provide a transfer device which can promptly transfer the workpiece with simple and compact structure from the withdrawal station to the scheduled position and from the scheduled position to the collecting station.

According to the present invention, this object is achieved by a transfer device comprising carrying means for picking up the workpiece from a withdrawal station, means for moving the carrying means from a withdrawal station to a scheduled position for working and vice versa, and chute means for receiving the workpiece for transfer to a collecting station upon completion of the working, the chute means being attached to the carrying means.

As will become clear in the course of the following description, the transfer device according to the present invention is simple and compact and can be associated with any known type of manipulator device without interfering with movements of the manipulator and without obstructing access to the withdrawal and collecting stations.

Further characteristics and advantages of the present invention will become clear from the detailed description which follows with reference to the appended drawings.

DETAILED DESCRIPTION OF THE PREFERRED EMBODIMENTS

Figure 1:
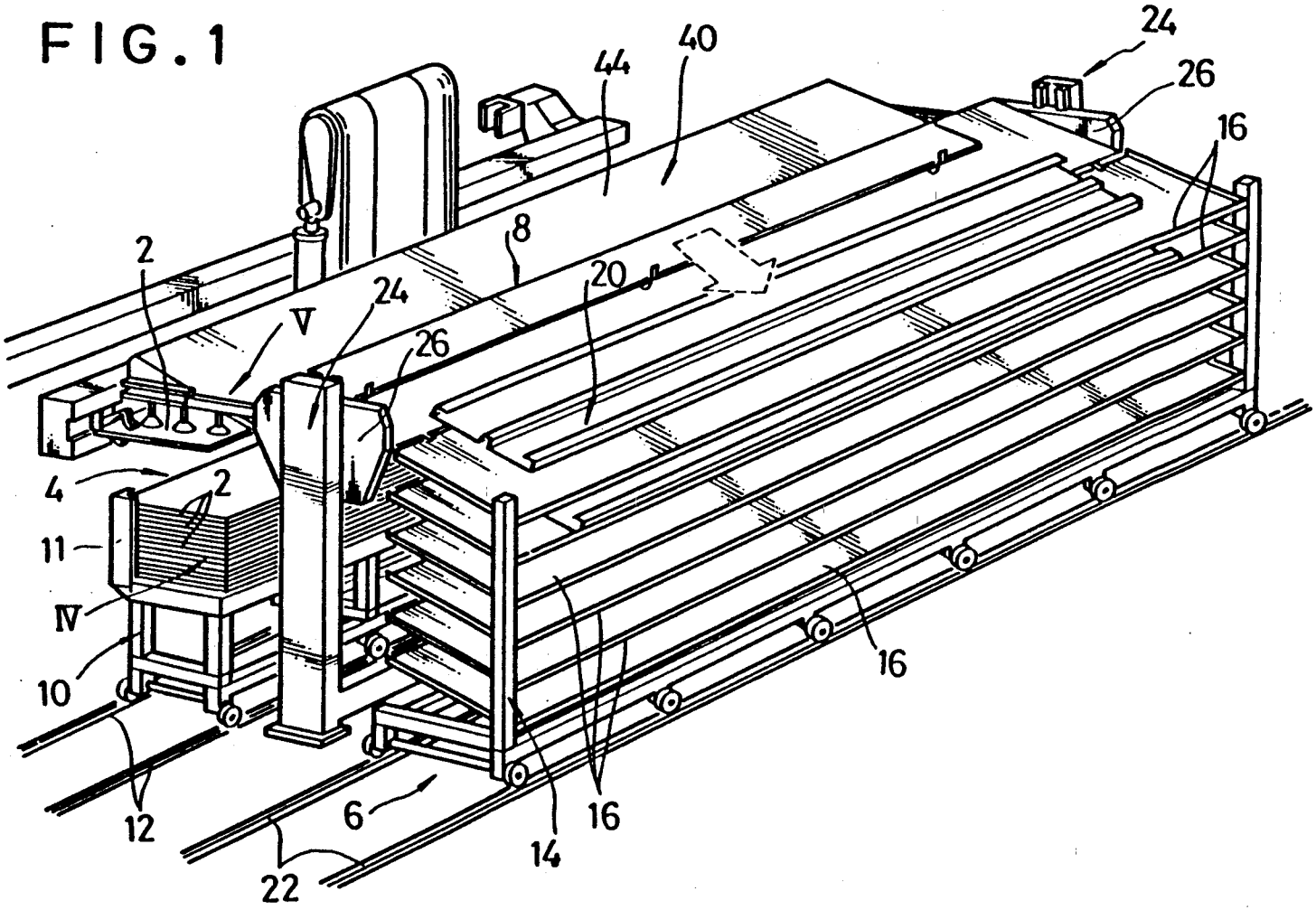
FIG. 1 is a perspective view of a loading and unloading station for metal sheet including a transfer device according to the present invention.

FIG. 1 shows a station for the loading and unloading of workpieces 2 constituted by elongate, rectangular metal sheets which are to undergo bending.

Figure 2:
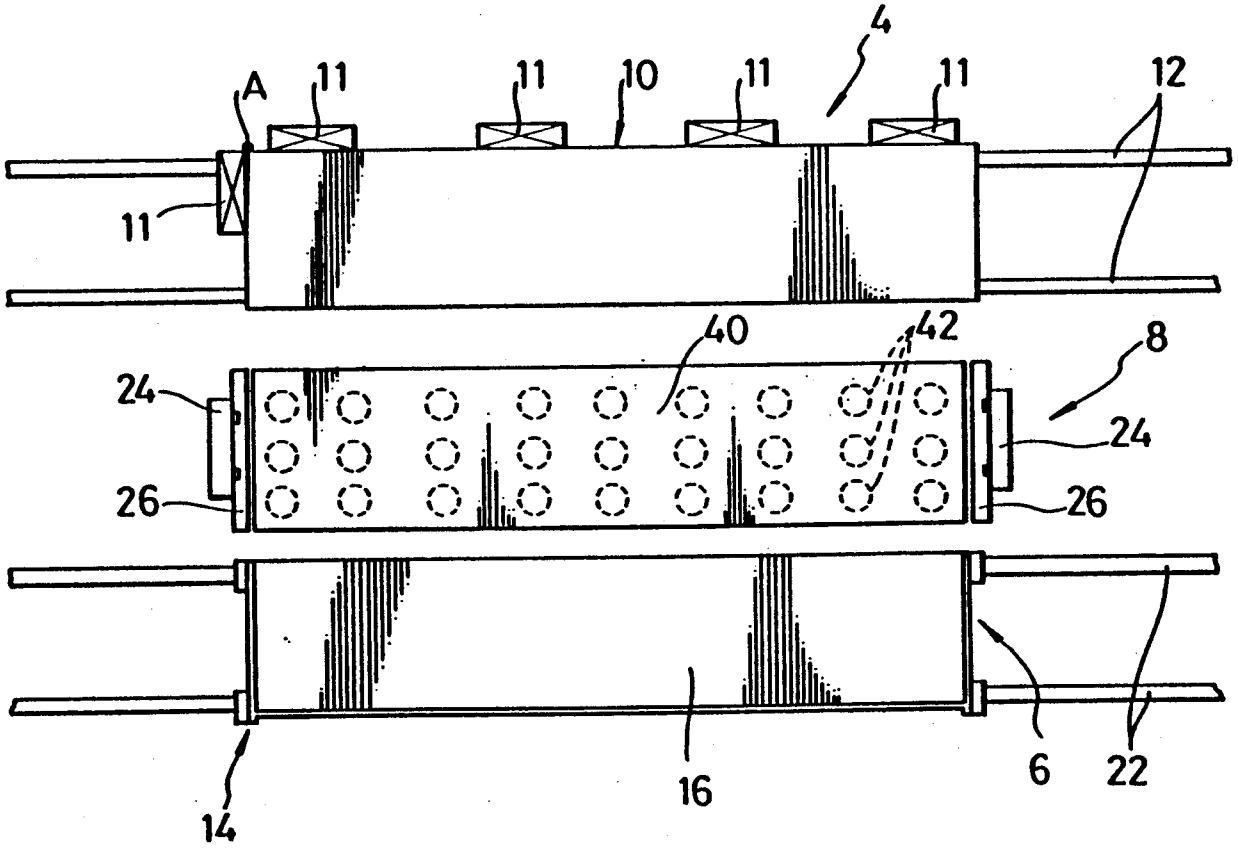
FIG. 2 is a plan view the loading and unloading station of FIG. 1.

The loading and unloading station includes a withdrawal station 4 and a collecting station 6 between which a transfer device 8 is located. The withdrawal station 4 is constituted by a trolley 10 which is movable on rails 12 and on which a pile of workpieces 2 to be worked is arranged. As can be seen in FIG. 2, the trolley 10 has a plurality of permanent magnets 11 arranged along two adjacent sides of the trolley 10. The magnets 11 separate the workpieces 2 and draw them to a predetermined configuration defined by the positions of the corners A of the workpiece 2.

The collecting station 6 is constituted by a trolley 14 in which a product 20 produced by working are deposited in the manner which will be described below. The trolley 14 is also movable on rails 22 which extend parallel to the rails 12 of the withdrawal station 4.

The transfer device 8 comprised a pair of box-shaped support and guide uprights 24 which face each other and are fixed to the floor between the rails 12, 22 of the withdrawal and collecting stations 4, 6. Respective slides 26 are mounted slidably on the uprights 24 and are movable vertically in synchronism.

Figure 3:
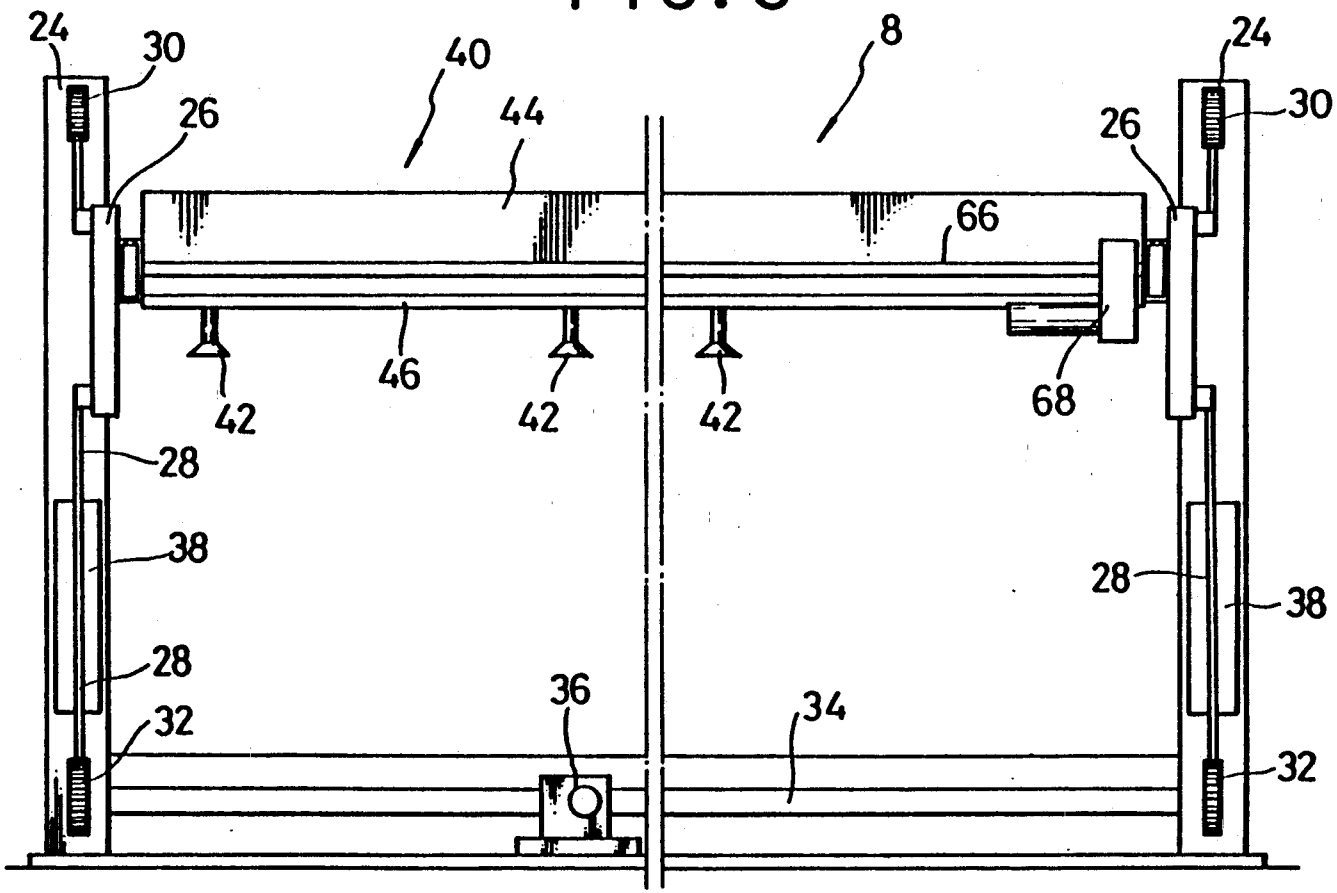
FIG. 3 is a front elevational view of the transfer device according to the present invention.
Figure 4:
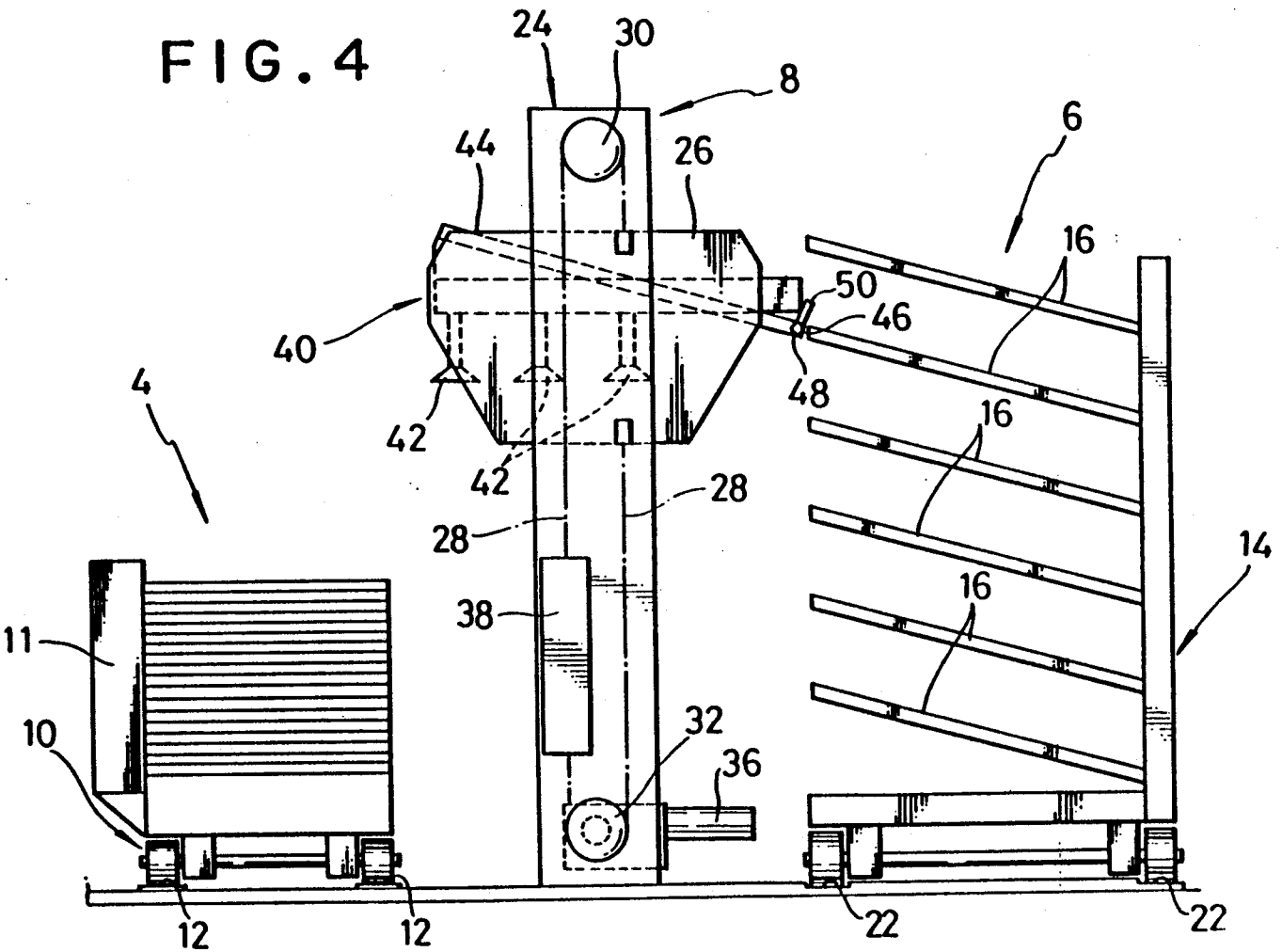
FIG. 4 is a side elevational view taken on the arrow IV of FIG. 1 in a different working configuration.

As can be seen in FIGS. 3 and 4, a drive chain 28 is arranged within each upright 24 and is returned by two pulleys 30 and 32 with fixed axes, the ends of the chain 28 being fixed to the slide 26. The lower pulleys 32 on the two uprights 24 are driven by a single drive shaft 34 which extends between the two uprights 24 and is driven by a geared motor 36. A counterweight 38 is fixed to each chain 28 and balances the weight bearing on the slide 26.

The slides 26 carry a carrying member 40 mounted for sliding horizontally relative to the slides 26. The carrying member 40 has a plurality of suction cups 42 connectible selectively to a vacuum source (not shown) so as to pick up the workpiece 2. Magnets or clamping device may alternatively be used in place of the suction cups 42. The carrying member 40 is also provided with a chute 44 onto which the workpiece 20 are discharged upon completion of the working, as will be described below. A shaft 48 carrying a plurality of stop pegs 50 is arranged in correspondence with the lower edge 46 of the chute 44 and extends along the lower edge 46. The shaft 48 is rotatable about its own axis and is driven by an actuator (not shown) which rotates the shaft 48 between a first position in which the pegs 50 constitute a stop for the product 20 on the chute 44 and a second position in which the pegs 50 do not obstruct the discharge of the product 20 from the chute 44.

Figure 5:
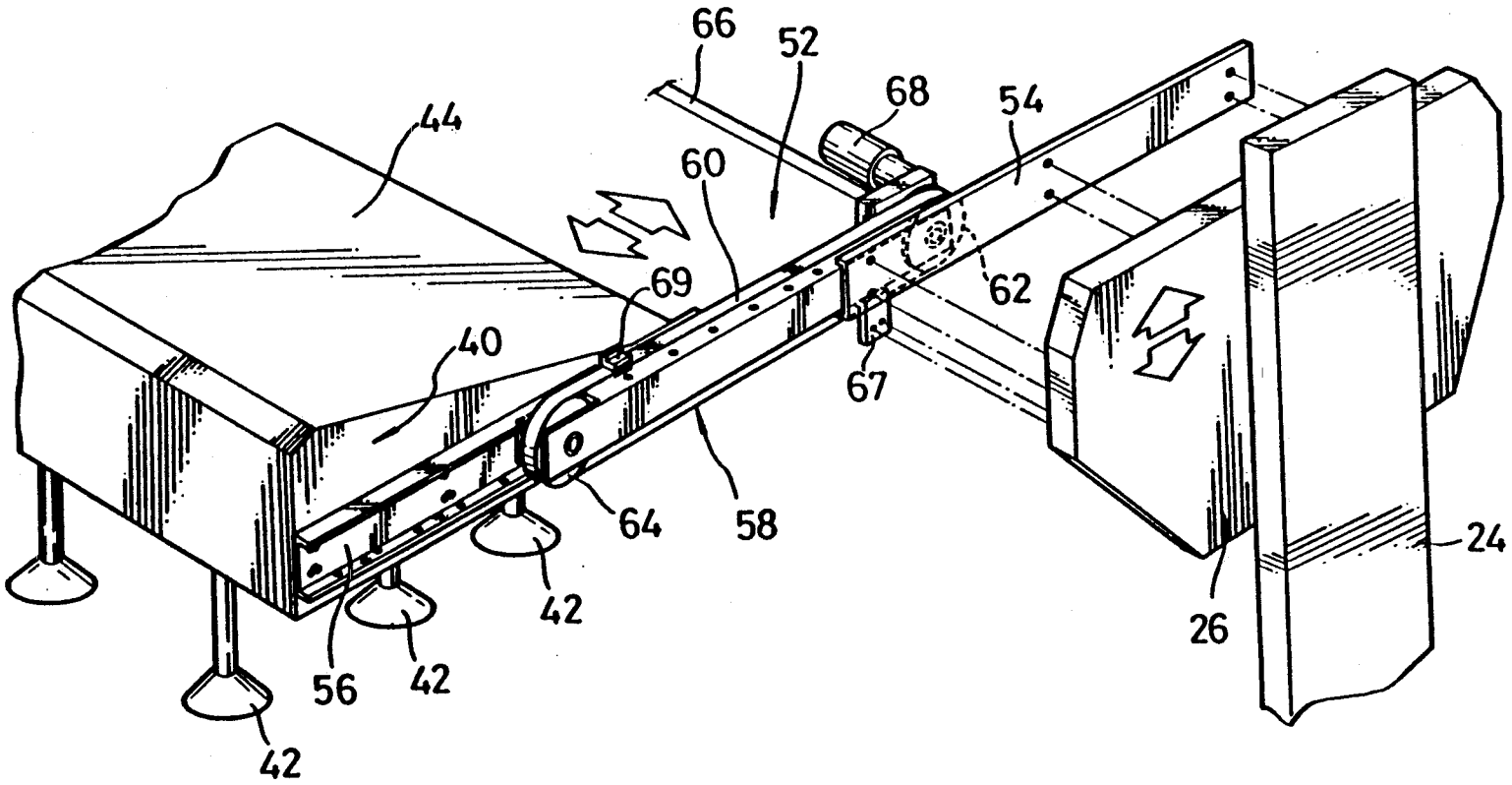
FIG. 5 is a perspective view of the part indicated by the arrow V of FIG. 1.

As can be seen in FIG. 5, the carrying member 40 is connected to the slides 26 by means of a pair of telescopic operating members 52, each of which includes a first guide 54 fixed to the respective slide 26, a second guide 56 fixed to the carrying member 40, and an intermediate element 58. Each intermediate element 58 carries a belt 60 which passes over two pulleys 62, 64 with fixed axes and has a first pass fixed to the first guide 54 and a second pass fixed to the second guide 56. That is, a portion of the belt 60 is connected to the first guide 54 with a fitting 67, and another portion of the belt 60 is connected to the second guide 56 with a fitting 69. The pulleys 62 of the two intermediate member 58 are driven by the same shaft 66 which in turn is driven by a geared motor 68. Since the belt 60 is connected to the first and second guides 54, 56, the rotation of the pulleys 62 makes the intermediate element 58 move with respect to the first guide 54 and makes the carrying member 40 move with respect to the intermediate 60, thereby the carrying member 44 moves back and forth with respect to the slides 26.

Figure 6:
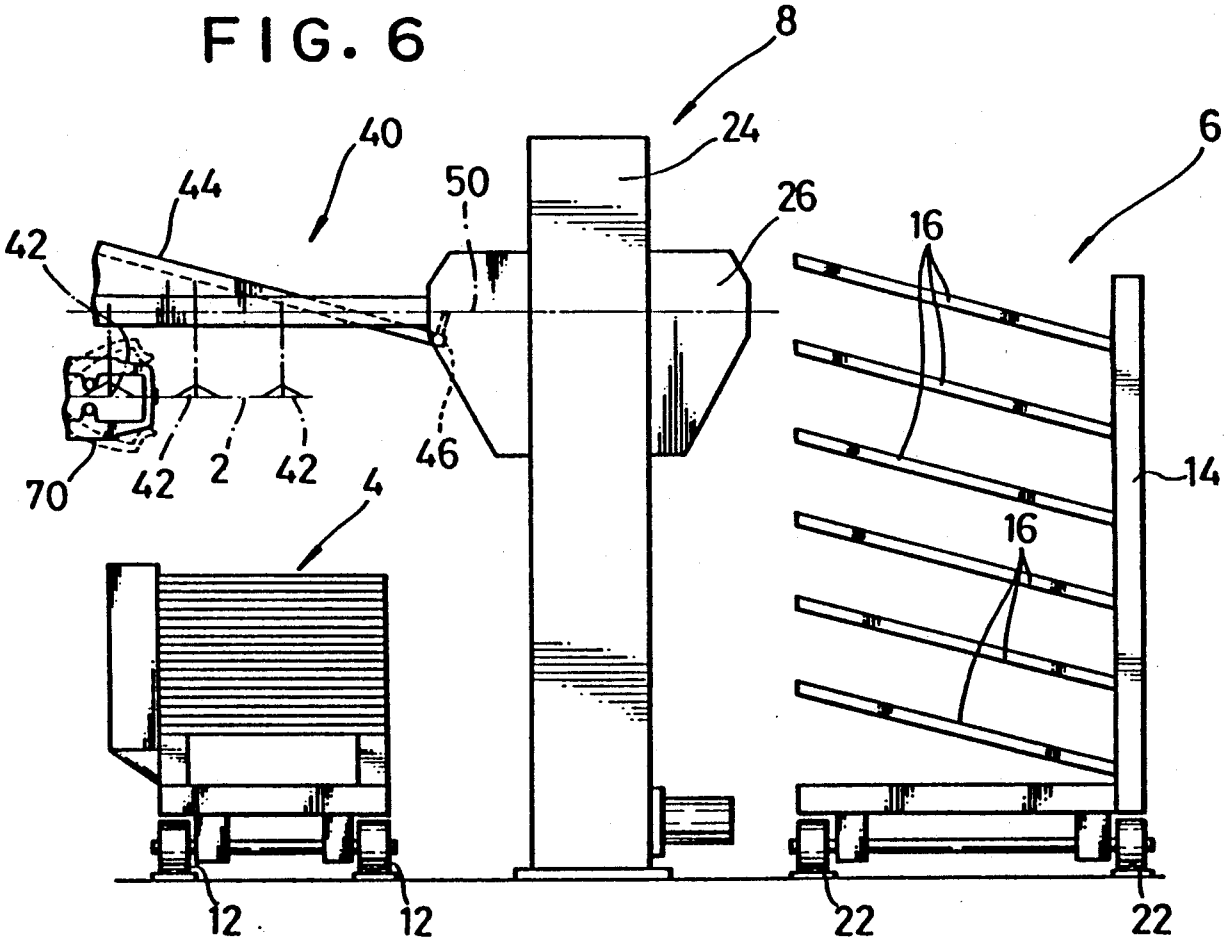
FIGS. 6, 7 and 8 are schematic views corresponding to FIG. 4 and showing the operating sequence of the device according to the present invention.

The operation of the transfer device 8 will be described below with reference to FIGS. 6, 7 and 8.

Under the control of a conventional control unit (not shown), the geared motor 36, 68 bring the suction cups 42 of the carrying member 40 into contact with the surface of the workpiece 2 at the top of the pile on the trolley 10. The vacuum source is then activated and the suction cups 42 pick up the workpiece 2. The slides 26 then move upwards and the telescopic members 52 bring the carrying member 40 to the configuration shown in FIG. 6. In this configuration, the workpiece 2 is picked up by the grips 70 of a manipulator device (not shown) which supplies the workpiece 2 to a bending machine, also not shown. The manipulator device associated with the transfer device 8 according to the present invention is preferably of the type described and illustrated in the Italian patent application entitled "A device for manipulating pieces of metal sheet" filed on Nov. 30, 1989 by the same applicant.

Figure 7:
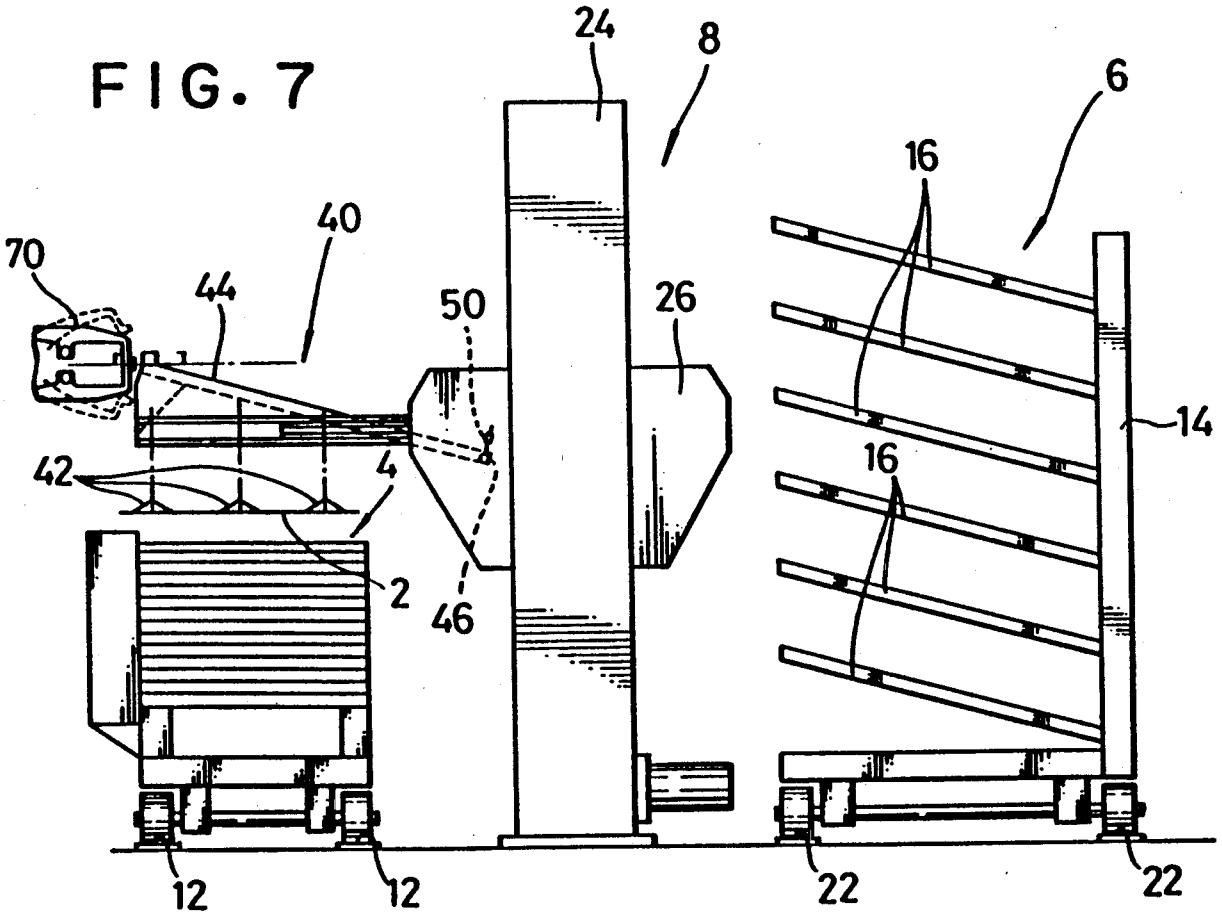

After the workpiece 2 is taken away by the grips 70, the carrying member 40 draws back and moves downwards to pick up a new workpiece 2 as shown in FIG. 7. Upon completion of the working of the former workpiece 2, the grips 70 of the manipulator device deposits the product 20 on the chute 44 as shown in FIG. 7. The pegs 50 are in their raised position and the product 20 is therefore retained on the chute 44. The new workpiece 2 is taken by the grips 70 as soon as it has discharged the product 20.

Figure 8:
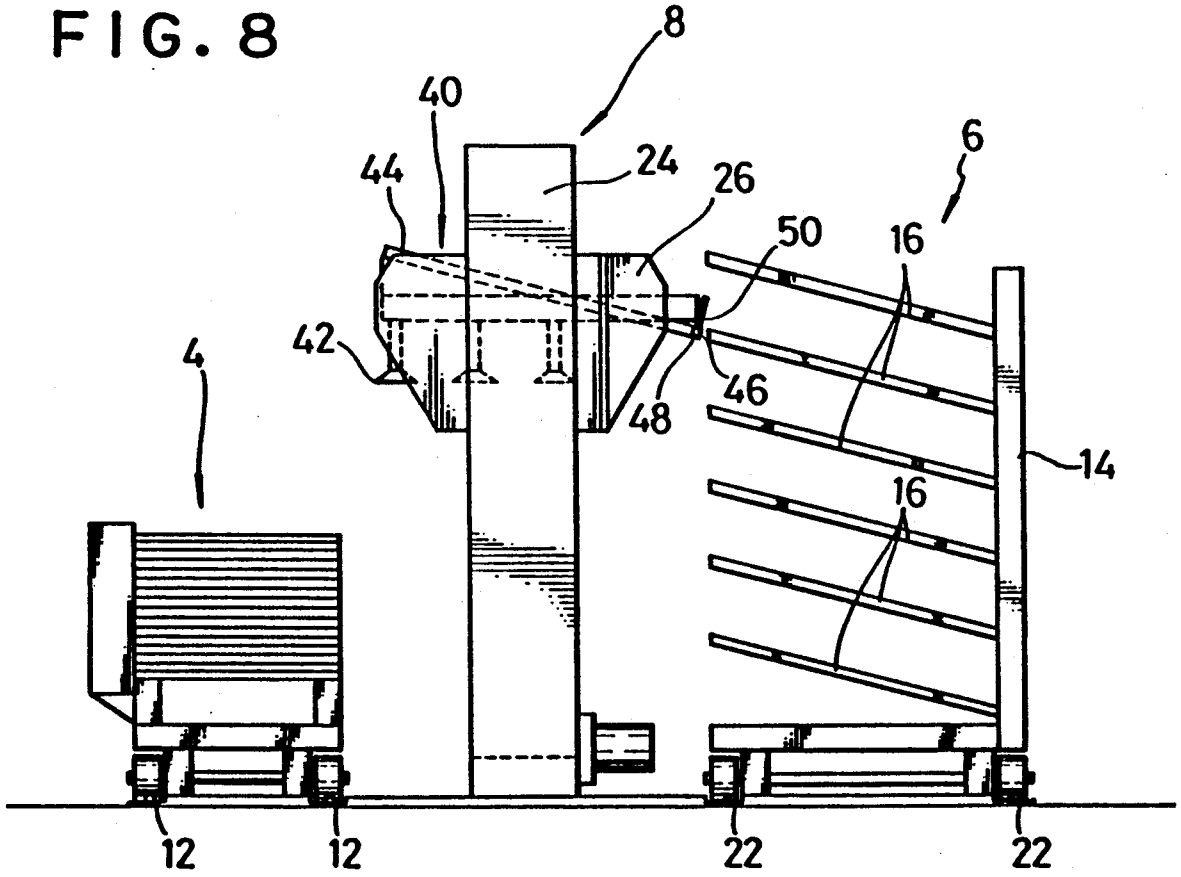

The carrying member 40 is then brought back between the slides 26 and these are then moved into correspondence with a compartment 16 of the trolley 14, as shown in FIG. 8. The shaft 48 is then rotated to lower the retaining pegs 50 and the product 20 on the chute 44 then slides into the compartment 16 of the trolley 14.

As stated above, the new workpiece 2 can be taken by the manipulator device immediately after the product 20 is discharged, thereby promptly transferring the new workpiece 2 to the grip 70. In addition, the product 20 can be promptly discharged to the collecting station 6 by means of the chute 44. As a whole, the time for transferring the workpiece is considerably reduced.

Naturally, the principle of the invention remaining the same, the forms of embodiment and details of construction may be varied widely with respect to those described and illustrated, without thereby departing from the scope of the present invention.

What is claimed is:

1. A device for transferring a workpiece to be presented for working, comprising:

support means; and a carrying member mounted on the support means movable in a vertical direction and in a forward direction, the carrying member having a pick-up device at a lower portion for picking up a workpiece from a withdrawal station disposed in front of the support means, wherein a top surface of the carrying member is inclined backwardly so that the carrying member can discharge the workpiece to a collecting station disposed behind the support means, upon receiving the workpiece upon which working has been completed.

2. The transfer device of claim 1, wherein the support means include a pair of guide upright supports between and on which the carrying member is disposed through a pair of vertically movable slides mounted on the upright supports.

3. The transfer device of claim 1, wherein the carrying member is moved in the forward direction by a telescopic mechanism mounted on the support means.

4. The transfer device of claim 1, wherein stopper means for holding the workpiece on the inclined surface is disposed on a lower end of the inclined surface, the stopper means being movable in order to allow the workpiece to slide down to be discharged.

5. The transfer device of claim 4, wherein the stopper means comprise a plurality of pegs fixed to an operating shaft extending along the lower end of the inclined surface.

6. The transfer device of claim 3, wherein the telescopic mechanism comprises a pair of first guides fixed to the support means, a pair of second guides fixed to the carrying member, and a pair of transmission elements each of which carrying a transmission device having first and second passes connected to the first and second guides.

7. The transfer device of claim 6, the transmission devices of the two transmission elements are driven by a single shaft provided on the carrying member.

8. The transfer device of claim 2, wherein each upright support is provided with a driving chain for moving the slide vertically, the chains of the upright supports are driven by a shaft extending between the upright supports.

9. The transfer device of claim 8, wherein each chain extends in a closed path and has a first fall fixed to the slide and a second fall carrying a counterweight for balancing the weight of the slide.

10. A device for transferring a workpiece to be presented for working, comprising:

carrying means for picking up the workpiece from a withdrawal station;

means for moving the carrying means from a withdrawal station to a scheduled position for working, the moving means including a pair of guide uprights on which respective slides carrying the carrying means can slide, the moving means including a pair of telescopic operating members associated with the carrying means and adapted to move the carrying means substantially perpendicular to the direction of sliding of the slides, each telescopic operating member comprising a first guide fixed to the respective slide, a second guide fixed to the carrying means, and a transmission element having first and second passes connected to the first and second guides and chute means for receiving the workpiece from the scheduled position for transfer to a collecting station upon completion of the working, the chute means being attached to the carrying means.

11. A device for transferring a workpiece to be presented for working, comprising:

carrying means for picking up the workpiece from a withdrawal station;

means for moving the carrying means from a withdrawal station to a scheduled position for working, the moving means including a pair of guide uprights on which respective slides carrying the carrying means can slide, and a chain for operating the respective slide mounted on each of the guide uprights, the chains of the two uprights driven by a shaft extending between the two uprights; and chute means for receiving the workpiece for transfer to a collecting station upon completion of the working, the chute means being attached to the carrying means.

* * * * *